US009194579B2

(12) United States Patent
Martin et al.

(10) Patent No.: US 9,194,579 B2
(45) Date of Patent: Nov. 24, 2015

(54) AERODYNAMIC RADIANT WALL BURNER TIP

(71) Applicant: Honeywell International Inc., Morristown, NJ (US)

(72) Inventors: Richard Ray Martin, Tulsa, OK (US); Matthew Martin, Tulsa, OK (US)

(73) Assignee: HONEYWELL INTERNATIONAL, INC., Morris Plains, NJ (US)

( * ) Notice: Subject to any disclaimer, the term of this patent is extended or adjusted under 35 U.S.C. 154(b) by 522 days.

(21) Appl. No.: 13/652,928

(22) Filed: Oct. 16, 2012

(65) Prior Publication Data

US 2014/0102440 A1 Apr. 17, 2014

(51) Int. Cl.

| | |
|---|---|
| ***F23D 14/06*** | (2006.01) |
| ***F23C 6/04*** | (2006.01) |
| ***F23D 14/12*** | (2006.01) |
| ***F23D 14/58*** | (2006.01) |
| ***F23D 14/84*** | (2006.01) |

(52) U.S. Cl.

CPC ..... *F23D 14/06* (2013.01); *F23C 6/047* (2013.01); *F23D 14/125* (2013.01); *F23D 14/58* (2013.01); *F23D 14/84* (2013.01); *F23C 2900/06043* (2013.01); *F23D 2900/00008* (2013.01)

(58) Field of Classification Search

CPC ..... F23D 14/125; F23D 14/06; F23D 14/58; F23D 14/84; F23D 2900/06043; F23D 2900/00008

USPC ..... 431/326, 328

See application file for complete search history.

(56) References Cited

U.S. PATENT DOCUMENTS

| | | | | |
|---|---|---|---|---|
| 3,000,435 | A * | 9/1961 | Bloom et al. | 431/348 |
| 4,702,691 | A | 10/1987 | Ogden | |
| 5,271,729 | A * | 12/1993 | Gensler et al. | 431/175 |
| 6,607,376 | B2 | 8/2003 | Poe | |
| 6,796,790 | B2 | 9/2004 | Venizelos et al. | |

FOREIGN PATENT DOCUMENTS

| | | | |
|---|---|---|---|
| CA | 2372346 | * | 9/2001 |
| WO | WO8401205 A1 | * | 3/1984 |

* cited by examiner

*Primary Examiner* — Kenneth Rinehart
*Assistant Examiner* — Gajanan M Prabhu

(57) ABSTRACT

A radiant wall burner apparatus. The apparatus includes an inlet and primary fuel tip for introduction of fuel gas and air mixing in a mixing chamber. The fuel and air mixture are subject to a substantially uniform flow area from the point of discharge from a downstream portion of the mixing chamber up to the exit gap of the burner tip. The fuel gas and combustion air mixture terminate through the burner tip at a substantially uniform velocity. The radiant wall burner apparatus and burner tip allow for the substantially uniform velocity of the fuel gas and air mixture, reducing the potential for flashback of the burner tip.

12 Claims, 6 Drawing Sheets

AERODYNAMIC RADIANT WALL BURNER TIP

FIELD OF THE INVENTION

The present invention relates generally to an apparatus for a radiant wall burner. More particularly, the present invention relates to an improved, aerodynamic burner tip for use in premixed fuel gas burners for furnaces.

DESCRIPTION OF THE RELATED ART

Radiant wall, premix fuel gas burners used in furnaces provide high heat release in a small disk-shaped volume adjacent to a refractory wall while providing low pollutant gas combustion emissions. Depending on the composition of the fuel, flashback is a possible problem in a premix gas burner. Flashback is the combustion of a premix of fuel and combustion air inside the radiant wall burner tip and the mixing chamber. It can occur when the flame propagation velocity exceeds the discharge velocity of the fuel and air mixture exiting the tip. The differences in velocities can cause the flame to propagate back into the tip and ignite the mixture inside the burner tip and the mixing chamber, leading to thermal damage to the burner tip and the mixing chamber. The thermally damaged burner tips may warp or droop, and in extreme cases may even fall off.

Preferably, the burner should be designed so that the discharge speed of the fuel and air mixture leaving the burner tip exceeds the flame speed. Current state of the art premix burners feature assembly geometry that do not provide a uniform flow of the fuel and air mixture and gives way to acceleration and deceleration of the fuel and air mixture, causing a non-uniform flow. As a result of such non-uniform flow, turbulence is created. Commonly in the art, burner tips feature a cylindrical tip design with multiple discharge openings or a multiple leaf design with slots separating the leaves through which the fuel and air mixture is discharged into the furnace. The nature of the design creates a situation where the flow is decelerated and then re-accelerated as it approaches the discharge openings. The resulting turbulence and differing velocities create non-uniform flow exiting the tip. In some locations the velocity can be extremely high, greatly exceeding the flame propagation speed, while in other locations the exit velocity can be extremely low, and in some cases even negative creating "reverse" flow back into the tip. Flashback may occur in the low velocity regions. When flashback occurs, however, these designs may fail. Under thermal stress, the tips tend to crack or even separate from the mixer and fall off into the furnace floor.

The multiple discharge openings in burner tip assemblies are usually in the form of narrow slots. Discharge openings are implemented to provide uniform radial distribution of the premix gas. These types of discharge openings are illustrated in U.S. Pat. No. 6,796,790 B2, U.S. Pat. No. 4,702,691 and U.S. Pat. No. 6,607,376 B2. The openings must allow maximum emission of the fuel and air mixture at sufficient velocity to prevent flashback in the burner tip. Uniform radial and longitudinal distribution is achieved by accelerating the premix gas as it exits through the openings. Such acceleration creates a high internal tip pressure that limits the premix gas flow. The slotted discharge openings, however, decrease the burning capacity. Increasing the slot length provides additional area to increase burning capacity; however this may result in reverse flow back inside the tip with a higher probability of flashback.

Accordingly, it is an object and purpose of the present invention to provide an improved, aerodynamic radiant wall burner tip which provides a uniform flow area from discharge from the mixing chamber up to the exit ports of the burner tip allowing for an outward flowing fuel gas and air velocity substantially uniform as the gas exits the burner tip.

It is a further object and purpose of the present invention to provide an improved, aerodynamic radiant wall burner tip which reduces the potential of flashback in the burner tip.

It is a further object and purpose of the present invention to provide an improved, aerodynamic radiant wall burner tip which thoroughly mixes air and fuel gas together while minimizing turbulence.

It is a further object and purpose of the present invention to provide an improved, aerodynamic radiant wall burner tip which maximizes the area of outward flowing fuel gas and air while minimizing turbulence.

It is a further object and purpose of the present invention to provide an improved, aerodynamic radiant wall burner tip which maximizes the quantity of outward flowing fuel gas and air while minimizing turbulence thereby increasing the burning capacity.

SUMMARY OF THE INVENTION

The present invention is directed to an improved method and radiant wall burner apparatus for conventional or low $NO_x$ emission burners.

The apparatus includes an elongated mixing chamber having an upstream portion and a downstream portion. An inlet is positioned adjacent to and in fluid communication with the upstream portion of the mixing chamber. Combustion air is introduced through the inlet and then moves into and through both the upstream and downstream portions of the mixing chamber. A burner tip is positioned adjacent to and in fluid communication with the downstream portion of the mixing chamber. A primary fuel tip and a secondary fuel tip are connected longitudinally to the mixing chamber, extending along an axis through the inlet, through the mixing chamber, and optionally, through the burner tip.

A stream of primary fuel gas is introduced through the inlet and into the downstream portion of the mixing chamber. As primary fuel gas is introduced into the mixing chamber, combustion air is caused to be inspirated or drawn into the upstream portion of the mixing chamber through the inlet. The primary fuel gas and the combustion air combine in the mixing chamber. The mixture flows in the direction from the upstream portion of the mixing chamber to the downstream portion of the mixing chamber along the axis.

The burner tip is in fluid communication with the downstream portion of the mixing chamber. The burner tip may include a concave discoidal upper leaf and a discoidal lower leaf. The upper leaf and the lower leaf form a constant flow area for the fuel and air mixture. Thereby, from the point of discharge from the downstream portion of the mixing chamber up into the burner tip leaves, the fuel and air mixture is subject to a constant flow area. The burner tip terminates at an exit gap defined by two discoidal leaves where the combustion air and primary fuel mixture radially terminates. Optionally, in a low NOx burner, a secondary fuel tip is connected to the primary fuel tip, extending past the burner tip leaves, supplying secondary fuel gas.

In one preferred embodiment, the primary fuel gas and air mixture is distributed radially through a single-piece burner tip that has a defined exit gap. From the point of discharge of the mixing chamber, the fuel and air mixture is subject to a uniform flow area up to the exit gap allowing the fuel and air mixture to exit at a substantially uniform velocity. Combustion occurs adjacent the exit gap outside of the burner tip.

Additionally, in another preferred embodiment, the primary fuel gas and air mixture distributes radially through a burner tip having a screen of a plurality of round openings enclosing the exit gap between the two leaves of the burner tip allowing the fuel and air mixture to exit at a substantially uniform velocity.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
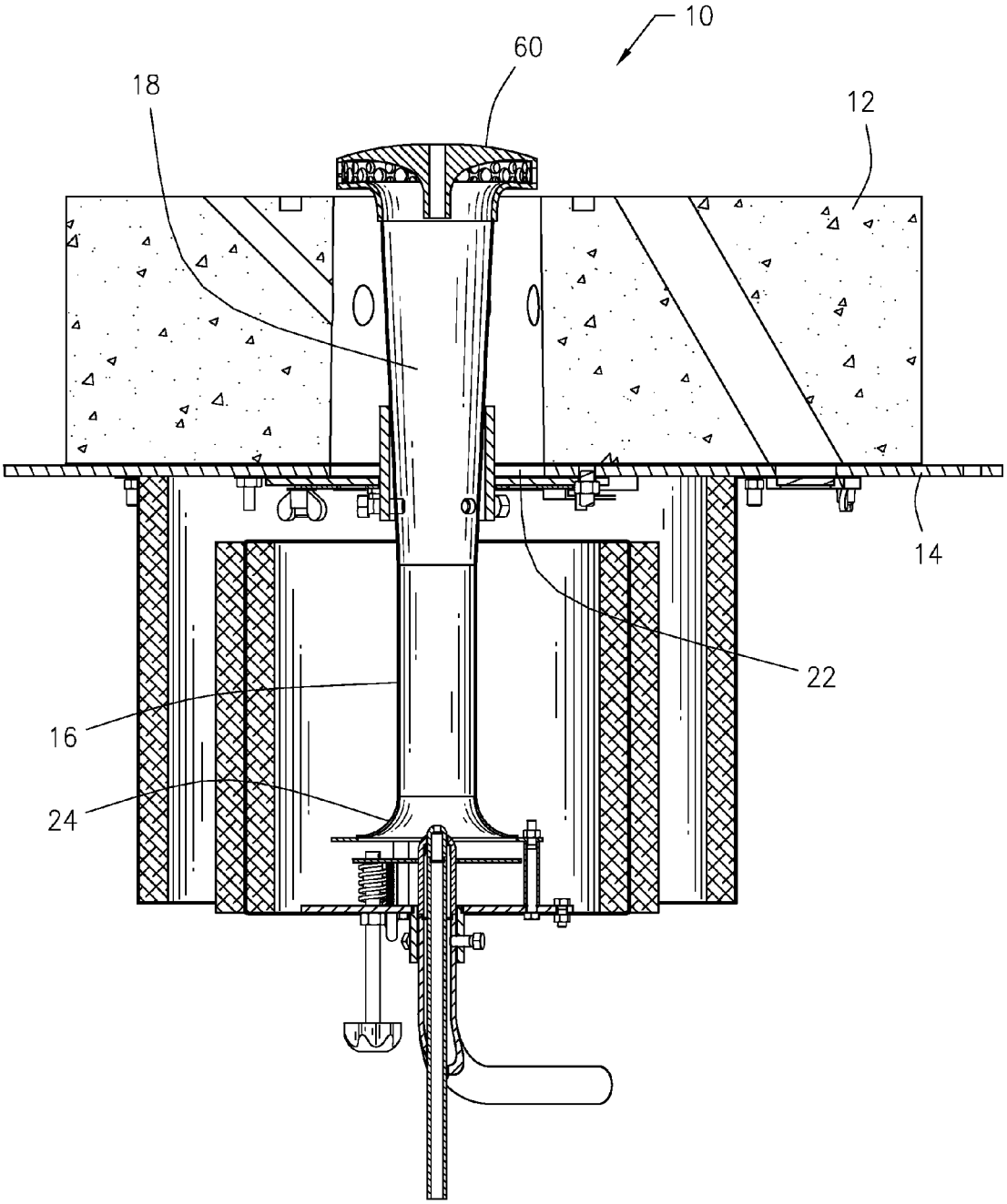
FIG. 1 illustrates a schematic diagram of a preferred embodiment of a radiant wall burner apparatus constructed in accordance with the present invention located in a furnace wall.

Referring to the drawings in detail, FIG. 1 illustrates a burner apparatus 10 as it can be located in a burner tile or furnace wall 12. The present invention is particularly suited for cracking and reforming furnaces although other furnaces are possible within the spirit and scope of the invention. The basic radiant wall burner shown here is merely typical, as the invention is not to be limited to the type shown. The mixing chamber and burner apparatus are supported by a mounting plate 14. The mounting plate 14 is located between an upstream portion 16 of the mixing chamber and a downstream portion 18 of the mixing chamber. The mounting plate 14 includes an opening 22 which may regulate the flow of secondary air.

Primary fuel gas is supplied through openings of a primary fuel tip 30 (shown in FIG. 3) and through an inlet 24 and into the upstream portion 16 of the mixing chamber. As primary fuel gas is introduced, combustion air is inspirated or drawn into and through the inlet 24 and into and through the upstream portion 16 of the mixing chamber. The combustion air and the primary fuel gas mix in the upstream portion 16 and in the downstream portion 18 of the mixing chamber. The downstream portion 18 of the mixing chamber terminates at a burner tip 60. The fuel and air mixture has a substantially constant flow area from the discharge point of the downstream portion of the mixing chamber 18, through the burner tip, and up to the exit gap of the burner tip 60. The burner tip 60 is positioned adjacent to and in fluid communication with the downstream portion of the mixing chamber 18. The burner tip 60 maintains the substantially constant flow area from the discharge point of the downstream mixing chamber 18. The fuel gas and air mixture flows from the downstream portion of the mixing chamber 18 and outwardly, radially through the burner tip 60 which is improved to allow for substantially uniform velocity of the mixture.

Figure 2:
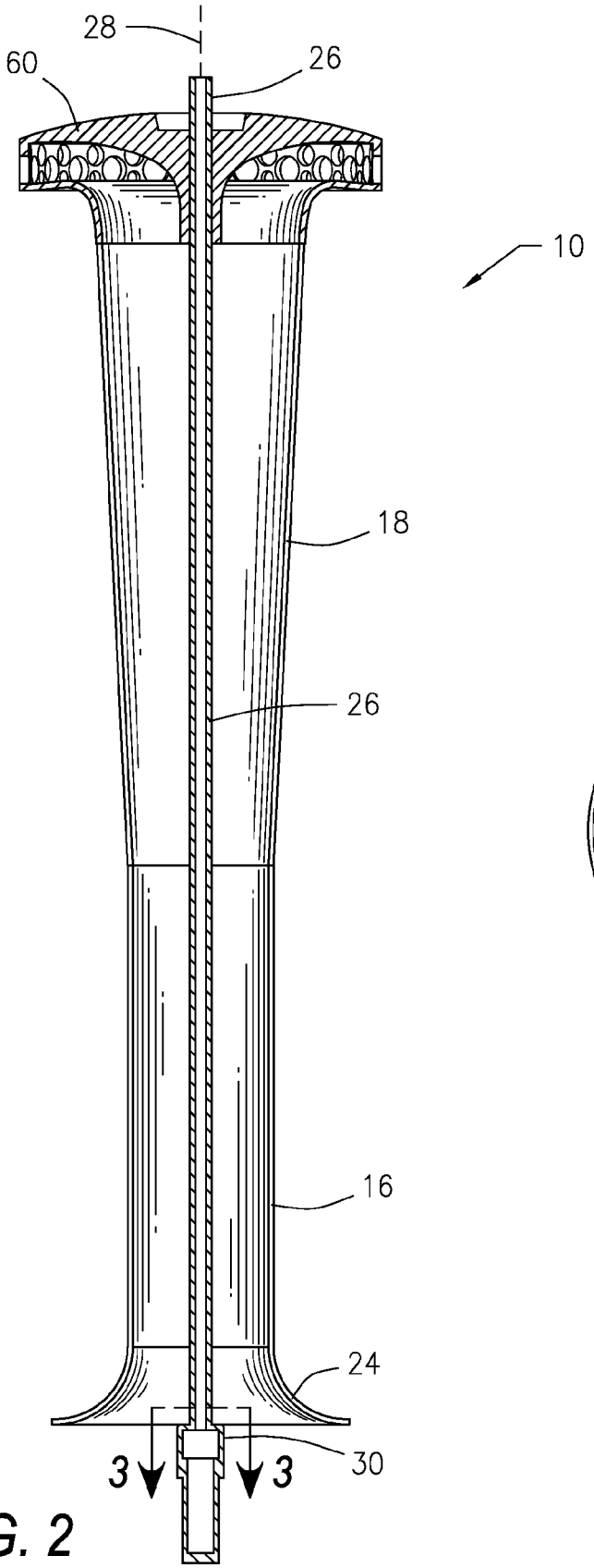
FIG. 2 illustrates a cross sectional view of the burner apparatus shown in FIG. 1.

FIG. 2 illustrates a cross sectional view of the radiant wall burner apparatus 10 as shown in FIG. 1. An optional secondary fuel tip 26 which may be included for Low NOx burners is shown. The secondary fuel tip 26 extends longitudinally from a primary fuel tip 30 along an axis 28, through the inlet 24, through the upstream portion 16 of the mixing chamber, through the downstream portion 18 of the mixing chamber, and can optionally extend through the burner tip 60. The secondary fuel tip 26 may extend through the burner tip 60 to supply secondary fuel gas outside of the burner tip 60, as typically demonstrated in low $NO_x$ burners.

Figure 3:
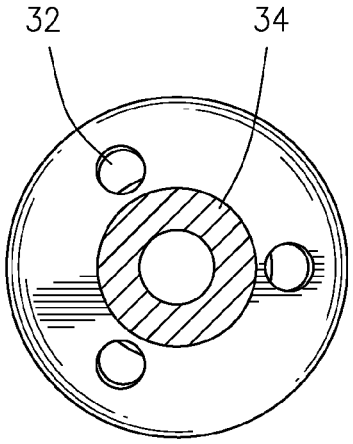
FIG. 3 illustrates a top view of the primary fuel tip and the secondary fuel tip of the burner apparatus shown in FIG. 1.

FIG. 3 illustrates a sectional view of the primary fuel tip 30 and the secondary fuel tip 26. Primary fuel gas enters through the inlet 24 and into the upstream portion of the mixing chamber 16 by way of openings 32. Optionally, secondary fuel gas is sourced by way of the central opening 34. Central opening 34 extends from the primary fuel tip 30 to the secondary fuel tip 26 providing secondary fuel outside of the burner tip 60 (as shown in FIGS. 1 and 2).

Figure 4:
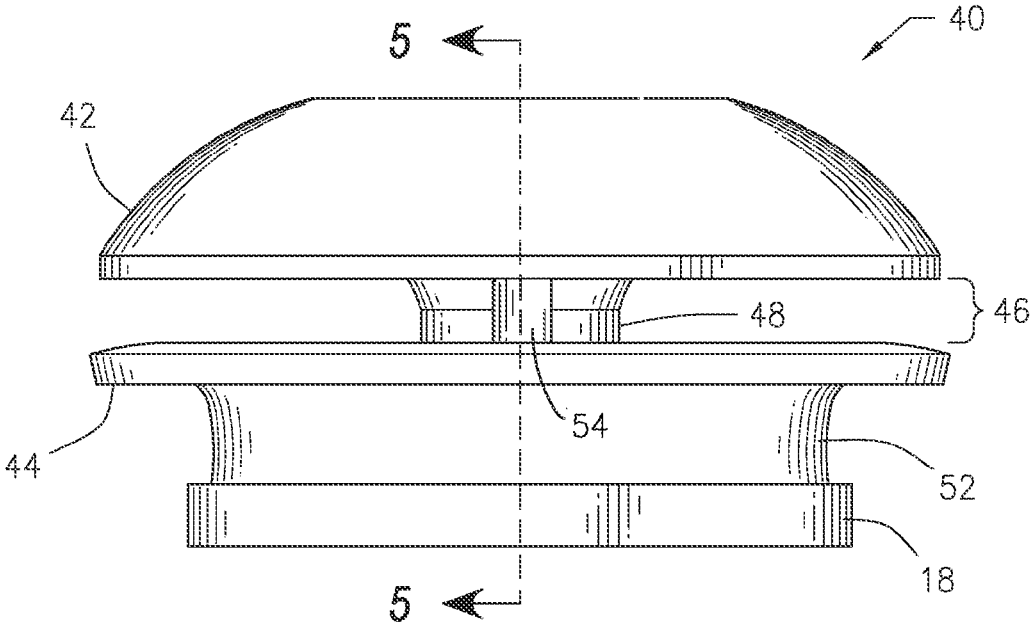
FIG. 4 illustrates a side view of a preferred embodiment of a burner tip of the radiant wall burner apparatus in accordance with the present invention.

FIG. 4 is a side view of one preferred embodiment of a burner tip 40 of the burner apparatus 10, as shown in FIGS. 1 and 2. In this preferred embodiment, the burner tip 40 may consist of two leaves, an upper leaf 42 and a lower leaf 44. Both leaves may be composed of a thick metal which will improve the conduction of heat away from any hot spots. The upper leaf 42 may be concave and discoidal with an outer circumference that extends radially toward the lower leaf 44 creating a slight, downward restriction directing the fuel and air mixture. The upper leaf 42 may have an inner circumference that extends and surrounds the distal end of the secondary fuel tip 26 (shown in FIGS. 1 and 2) creating a neck 48.

The lower leaf 44 may be discoidal with an outer circumference extending downwardly, creating a curved lip. The lower leaf 44 may have an inner circumference that creates an extension 52 for connection to the downstream portion of the mixing chamber 18. The upper leaf 42 and the lower leaf 44 may be at a set distance apart creating a flow passageway from downstream portion of the mixing chamber 18 to an exit gap 46. The distance between the upper leaf 42 and the lower leaf 44 maintains the constant flow area of the discharge point of the downstream portion of the mixing chamber 18, allowing for substantially uniform velocity of the fuel and gas mixture as it passes through the exit gap 46. The lower leaf 44 may also include optional discharge ports (not shown) along the curved lip of the outer circumference to provide for a source of ignition fuel and air for additional burner combustion stability of the fuel and gas mixture through the exit gap 46.

Figure 5:
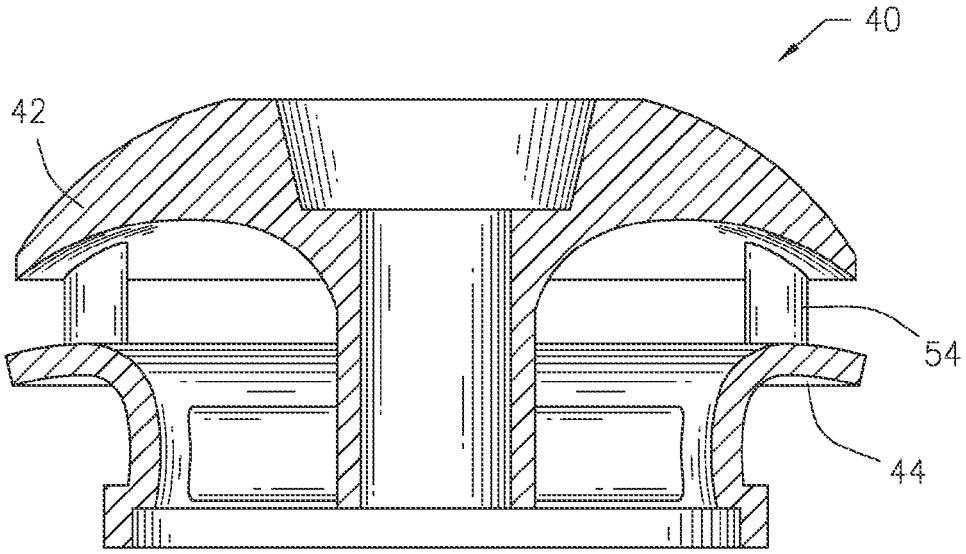
FIG. 5 illustrates a cross sectional view of an alternate preferred embodiment of a burner tip of the burner apparatus.
Figure 6:
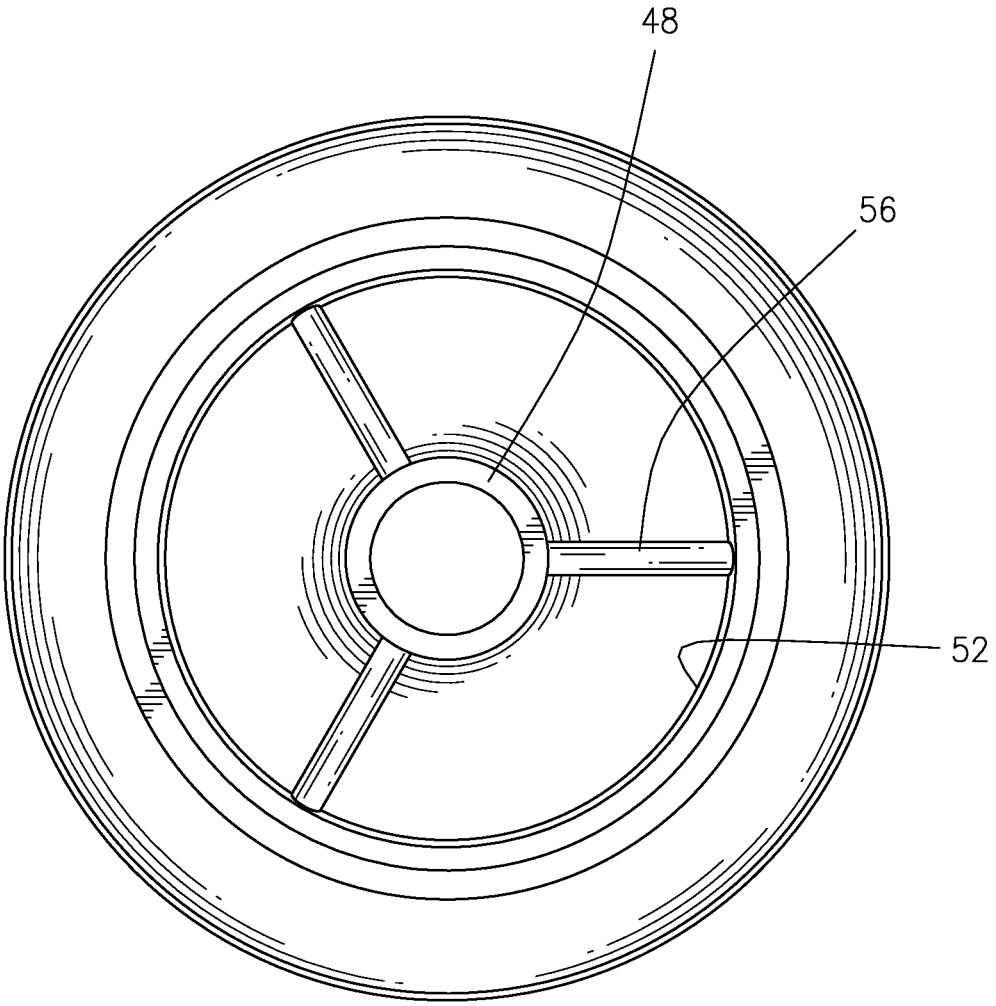
FIG. 6 illustrates a bottom view of a preferred embodiment shown in FIG. 4.

FIG. 5 is a cross sectional view of burner tip 40 as shown and described in FIG. 4. Aerodynamic support pins 54 may optionally be used to secure the upper leaf 42 and the lower leaf 44. The aerodynamic support pins 54 stabilize and anchor the burner tip leaves under thermal stress. Alternatively, as shown in FIG. 6, a bottom view of the burner tip 40 illustrates optional support pins 56 for stabilization between the neck 48 of the upper leaf 42 and the extension 52 of the lower leaf 44.

Figure 7:
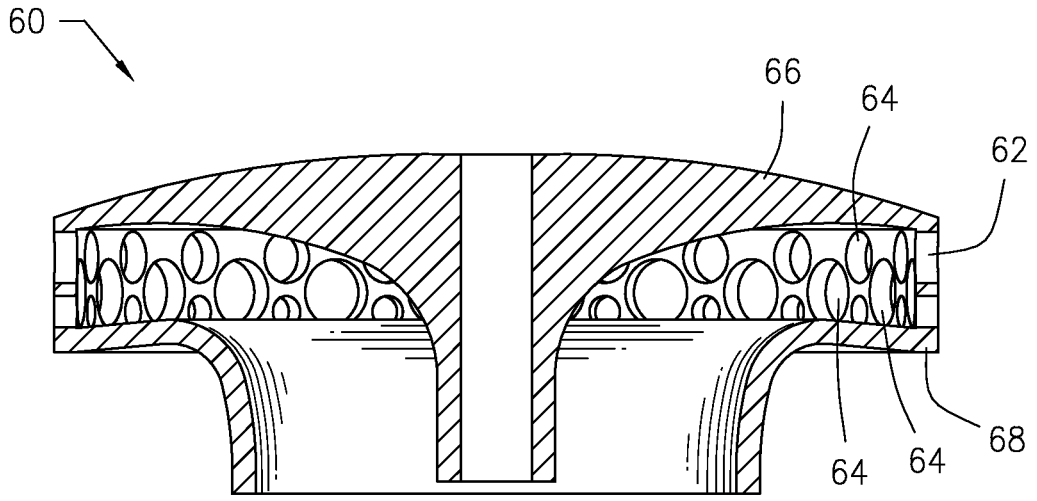
FIG. 7 illustrates a cross sectional view of the burner tip of the burner apparatus.

FIG. 7 is a cross sectional view of the burner tip 60 of FIG. 1. The burner tip 60 may be a two leaf design as described for burner tip 40 and may further include the addition of an optional cylindrical screen 62 at the exit gap 46 having a plurality of discharge ports 64 enclosing the leaves 66 and 68. The discharge ports 64 may be round in shape and may be of varied or of similar sizes. The sizes of the discharge ports 64 may be varied to facilitate uniform velocity of the fuel and air mixture through the burner tip 60. The size of the discharge ports 64 is indicative of the distance that the flame propagates outside of the burner tip. Thus, the size of the discharge ports may be varied for optimal flame propagation and uniform velocity of the fuel and air mixture.

Figure 8:
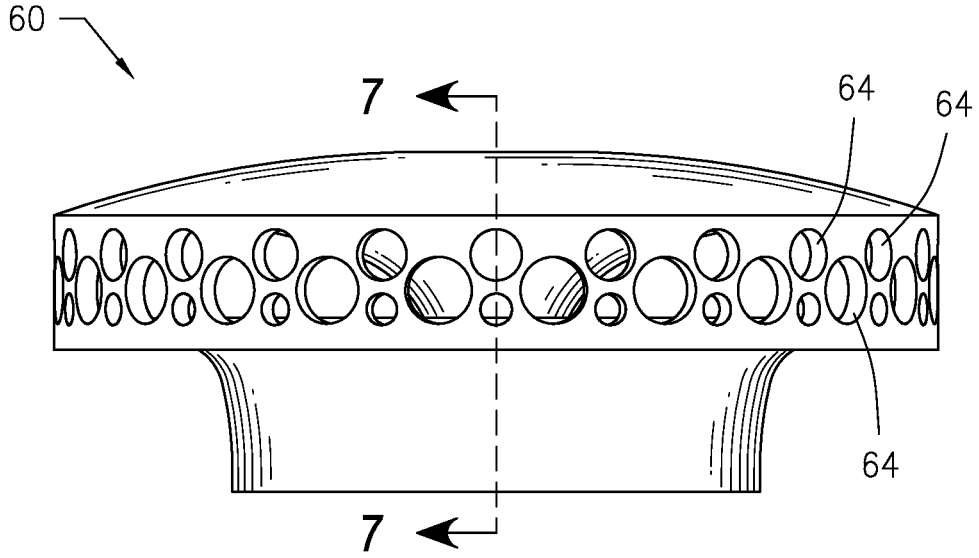
FIG. 8 illustrates a front view of the burner tip apparatus.

FIG. 8 illustrates a front view of burner tip 60. As shown in FIG. 8, the discharge ports 64 in the screen may be of varying size and strategically placed.

Figure 9:
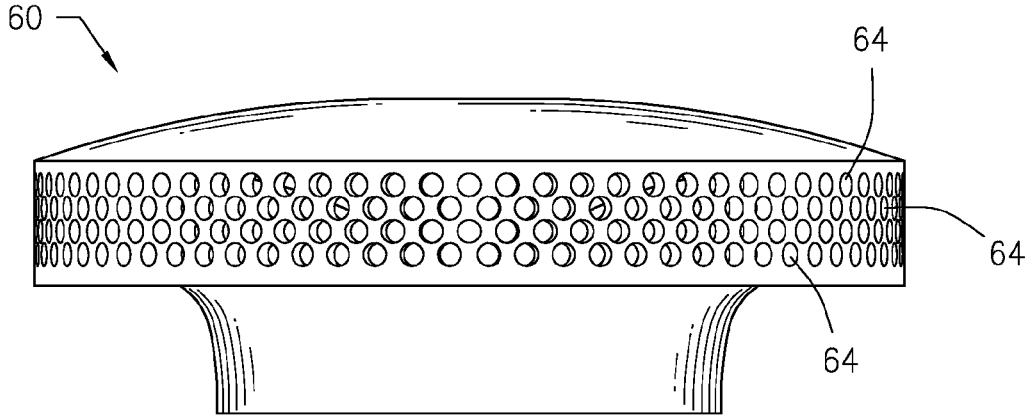
FIG. 9 illustrates an alternative preferred embodiment of a burner tip of the burner apparatus.

FIG. 9 illustrates an alternative embodiment of burner tip 60. As shown in FIG. 9, the discharge ports 64 of the screen may all be of similar, smaller size.

Figure 10:
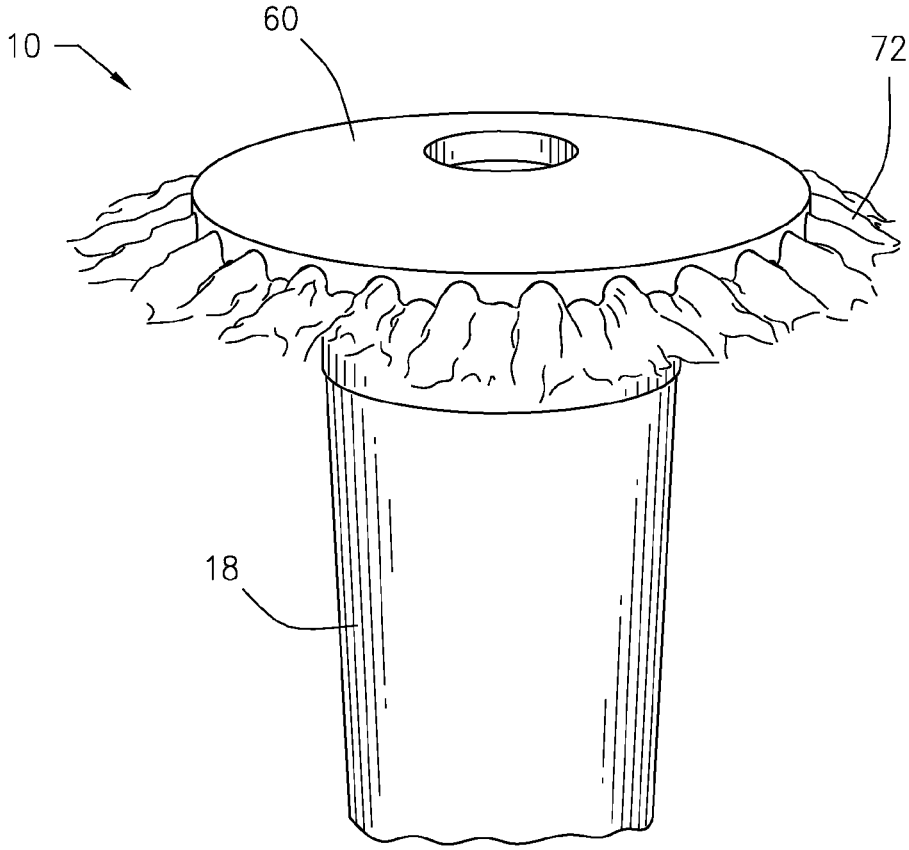
FIG. 10 illustrates the radial, uniform flow pattern from the burner tip.

FIG. 10 illustrates the burner tip 60 maintaining the same constant flow from the mixing chamber 18. The fuel gas and air mixture flows from the downstream portion of the mixing chamber 18, into the burner tip and outwardly, radially through the burner tip 60 creating a substantially uniform flow 72 of the mixture.

Accordingly, the embodiments disclosed in FIGS. 1 through 10 will tend to minimize flashback in the burner tips of radiant wall burners used in furnaces while maximizing the quantity of outward flowing fuel gas and air, thereby increasing the burner capacity.

Whereas, the devices and methods have been described in relation to the drawings and claims, it should be understood that other and further modifications, apart from those shown or suggested herein, may be made within the spirit and scope of this invention.

What is claimed is:

1. A radiant wall burner apparatus, which apparatus comprises:

an elongated mixing chamber having an upstream portion in fluid communication with a downstream portion;

an inlet adjacent to and in fluid communication with the upstream portion of the mixing chamber; and a burner tip in fluid communication with said downstream portion of the mixing chamber, wherein said burner tip includes an upper leaf and a lower leaf forming a constant flow area from said downstream portion of the mixing chamber up to an exit gap resulting in radial distribution of a fuel gas and air mixture at a substantially uniform velocity, wherein support pins connect a neck of said upper leaf and an extension of said lower leaf.

2. A radiant wall burner apparatus as set forth in claim 1 including a secondary fuel tip extending axially through said inlet, through said mixing chamber, and through said burner tip.

3. A radiant wall burner apparatus as set forth in claim 1 wherein said upper leaf is a concave and discoidal shape.

4. A radiant wall burner apparatus as set forth in claim 3 wherein said upper leaf has an outer circumference that extends radially downward toward said lower leaf.

5. A radiant wall burner apparatus as set forth in claim 1 wherein said lower leaf is discoidal.

6. A radiant wall burner apparatus as set forth in claim 5 wherein said lower leaf has an outer circumference extending downwardly creating a curved lip.

7. A radiant wall burner apparatus as set forth in claim 1 wherein an inner circumference of said lower leaf creates an extension connecting to said downstream portion of the mixing chamber.

8. A radiant wall burner apparatus as set forth in claim 1 including aerodynamically shaped supports extending between said upper leaf and said lower leaf.

9. A radiant wall burner apparatus as set forth in claim 1 wherein an outer circumference of said upper leaf has a downward restriction directing the fuel and air mixture.

10. A radiant wall burner apparatus as set forth in claim 1 including a cylindrical screen enclosing said upper leaf and said lower leaf, wherein said screen includes a plurality of round discharge ports for radial distribution of said fuel and air mixture.

11. A radiant wall burner apparatus as set forth in claim 10 wherein said round discharge ports are of varying sizes.

12. A radiant wall burner apparatus as set forth in claim 10 wherein round discharge ports are of similar size.

* * * * *